US008983324B2

(12) United States Patent
Kiuchi

(10) Patent No.: US 8,983,324 B2
(45) Date of Patent: Mar. 17, 2015

(54) FIXING DEVICE AND IMAGE FORMING APPARATUS

(71) Applicant: Fuji Xerox Co., Ltd., Tokyo (JP)

(72) Inventor: Yutaka Kiuchi, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 93 days.

(21) Appl. No.: 13/915,871

(22) Filed: Jun. 12, 2013

(65) Prior Publication Data

US 2014/0147149 A1 May 29, 2014

(30) Foreign Application Priority Data

Nov. 26, 2012 (JP) ..... 2012-257505

(51) Int. Cl.
*G03G 15/20* (2006.01)
*G03G 15/00* (2006.01)
*G03G 9/09* (2006.01)

(52) U.S. Cl.
CPC ..... *G03G 15/2028* (2013.01); *G03G 15/6585* (2013.01); *G03G 2215/0129* (2013.01); *G03G 9/0902* (2013.01); *G03G 9/0926* (2013.01)
USPC ..... 399/68; 399/67

(58) Field of Classification Search
CPC ..... G03G 15/2028; G03G 15/6585; G03G 9/0902; G03G 9/0926; G03G 2215/0129
USPC ..... 399/67, 68
See application file for complete search history.

(56) References Cited

U.S. PATENT DOCUMENTS

| | | | | |
|---|---|---|---|---|
| 6,885,830 | B2 * | 4/2005 | Hirota et al. | 399/12 |
| 8,577,230 | B2 * | 11/2013 | Yamashina | 399/15 |
| 2011/0318036 | A1 * | 12/2011 | Abe et al. | 399/67 |

FOREIGN PATENT DOCUMENTS

| | | |
|---|---|---|
| JP | A-2006-050347 | 2/2006 |
| JP | A-2009-145376 | 7/2009 |
| JP | A-2012-037618 | 2/2012 |

* cited by examiner

*Primary Examiner* — Hoang Ngo
(74) *Attorney, Agent, or Firm* — Oliff PLC

(57) ABSTRACT

An image forming apparatus includes an image forming unit that forms a metallic toner image on a recording medium using a metallic toner containing flakes of metallic pigment; and a heating portion that heats and melts the metallic toner on the recording medium. A first shearing force is applied to the molten metallic toner in a transportation direction of the recording medium.

19 Claims, 11 Drawing Sheets

FIXING DEVICE AND IMAGE FORMING APPARATUS

CROSS-REFERENCE TO RELATED APPLICATIONS

This application is based on and claims priority under 35 USC 119 from Japanese Patent Application No. 2012-257505 filed Nov. 26, 2012.

BACKGROUND (i) Technical Field

The present invention relates to fixing devices and image forming apparatuses.

(ii) Related Art

When an image forming apparatus, such as a photocopier or a printer, forms a glittery image having a metallic color such as gold or silver, the image of the metallic color is formed on a recording medium by using a metallic toner. Such a metallic color is reproduced by, for example, adding pigment containing metal powder, such as silver powder, as a principal component to a metallic toner.

SUMMARY

According to an aspect of the present invention, n image forming apparatus includes an image forming unit that forms a metallic toner image on a recording medium using a metallic toner containing flakes of metallic pigment; and a heating portion that heats and melts the metallic toner on the recording medium. A first shearing force is applied to the molten metallic toner in a transportation direction of the recording medium.

BRIEF DESCRIPTION OF THE DRAWINGS

Exemplary embodiments of the present invention will be described in detail based on the following figures, wherein.

DETAILED DESCRIPTION

Exemplary Embodiment

Figure 1:
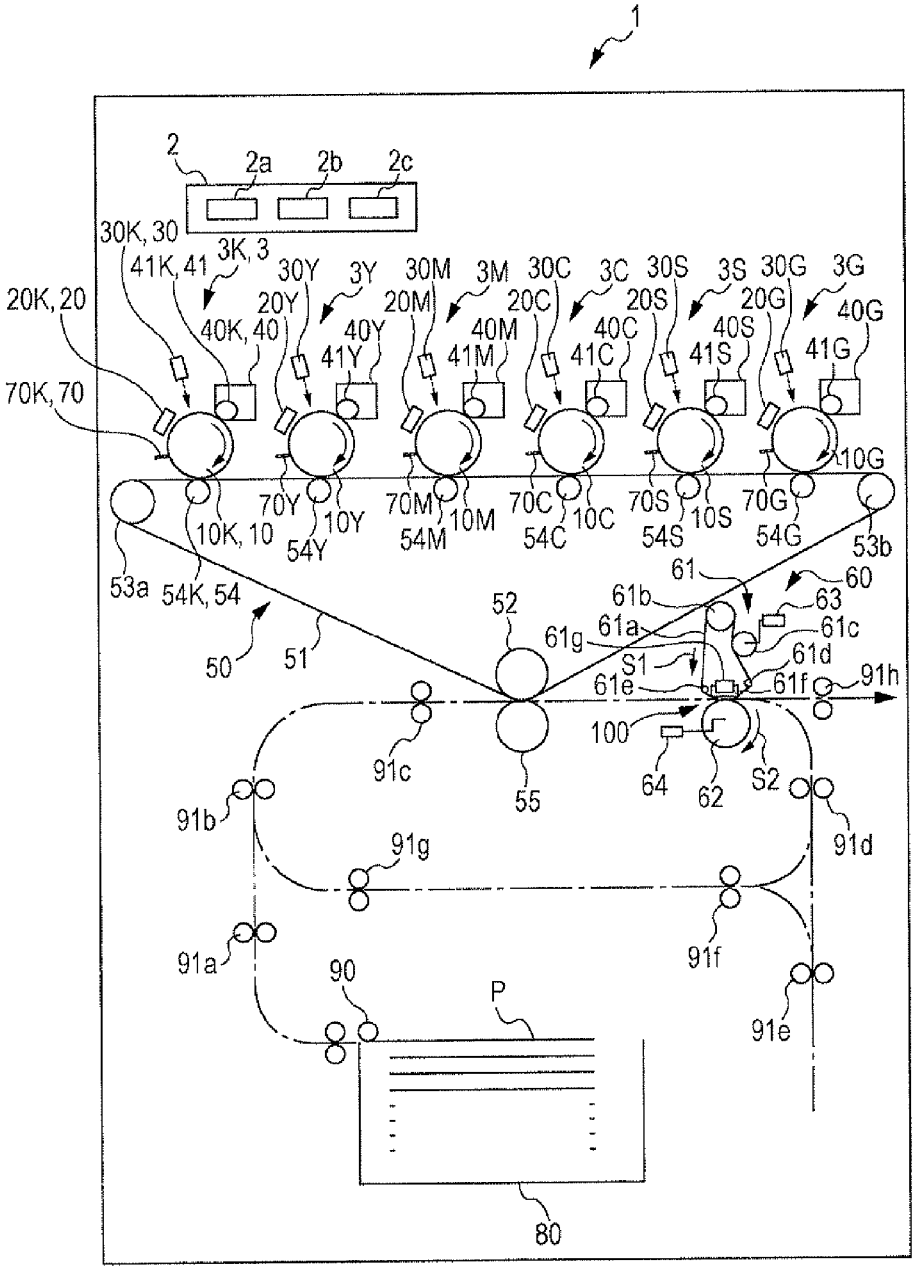
FIG. 1 schematically illustrates an image forming apparatus including a fixing device according to an exemplary embodiment.

Referring to the drawings, an exemplary embodiment of the present invention is described below. FIG. 1 schematically illustrates an image forming apparatus 1 including a fixing device 60 according to the exemplary embodiment of the present invention. The image forming apparatus 1 according to the exemplary embodiment includes a controller 2, image forming units 3K, 3Y, 3M, 3C, 3S, and 3G, a transfer unit 50, a fixing device 60, and a sheet storage 80. The image forming apparatus 1 forms an image on a sheet P, which serves as a recording medium, on the basis of input image data supplied thereto.

The image forming units 3K to 3G form toner images of black (K), yellow (Y), magenta (M), cyan (C), silver (S), and gold (G). As illustrated in FIG. 1, each of the image forming units 3K to 3G includes a corresponding one of photoconductors 10K to 10G, a corresponding one of charging units 20K to 20G, a corresponding one of exposure units 30K to 30G, a corresponding one of developing units 40K to 40G, and a corresponding one of cleaning units 70K to 70G. The image forming apparatus 1 forms a metallic image by using the image forming units 3S and 3G and forms a color image by using the image forming units 3K to 3C. In the case where the image forming units 3K to 3G do not particularly have to be distinguished from one another, each of the image forming units 3K to 3G is also described simply as an image forming unit 3.

The controller 2 includes an arithmetic unit such as a central processing unit (CPU) and a memory to control operations of components of the image forming apparatus 1. The controller 2 also includes a rotation controller 2*a*, a shearing force controller 2*b*, and an image converter 2*c*. Functions of these units will be described below.

Each of the photoconductors 10 (10K to 10G) is a cylindrical rotating body that rotates in a direction of the arrow of FIG. 1 and that has a photosensitive layer made of an organic photosensitive material to hold an image.

Each of the charging units 20 (20K to 20G) applies a predetermined charging voltage to the surface of the photoconductor 10 using, for example, a charging roller that rotates while coming into contact with the surface of the photoconductor 10. The charging unit 20 may be a contact-type charging unit that charges the photoconductor 10 while coming into contact with the photoconductor 10 using a brush or may be a non-contact-type charging unit that charges the photoconductor 10 using a corona discharge.

Each of the exposure units 30 (30K to 30G) emits light based on image data to the surface of the corresponding photoconductor 10 charged by the corresponding charging unit 20 and forms an electrostatic latent image having a latent image potential using a potential difference. As the photoconductor 10 rotates, the electrostatic latent image moves to a position at which the corresponding developing unit 40 is disposed.

Each of the developing units 40 (40K to 40G) has a rotatable developing roller 41 (a corresponding one of the developing rollers 41K to 41G) and a toner adhering to the developing roller 41 transfers to the corresponding photoconductor 10. Specifically, the toner transfers to the surface of the photoconductor 10 due to there being a potential difference between the charged toner and the electrostatic latent image formed on the photoconductor 10. Consequently, a toner image is formed on the photoconductor 10. The toner image moves to a position at which the transfer unit 50 is disposed as the photoconductor 10 rotates.

The transfer unit 50 includes an intermediate transfer belt 51, a back-up roller 52, transporting rollers 53*a* and 53*b*, first transfer rollers 54 (54K to 54G), and a second transfer roller 55. The transfer unit 50 transfers the toner images formed on the intermediate transfer belt 51 to a sheet P that has been transported thereto by transporting rollers 91*a*, 91*b*, and 91*c*. The sheet P to which the toner images have been transferred is transported to the fixing device 60.

The intermediate transfer belt 51 is stretched by the transporting rollers 53*a* and 53*b* and the back-up roller 52. The intermediate transfer belt 51 is driven to rotate by, for example, the transporting roller 53*a*. The first transfer rollers 54 are disposed so as to face the photoconductor 10 with the intermediate transfer belt 51 interposed between the first transfer rollers 54 and the photoconductor 10. Specifically, the first transfer roller 54K faces the photoconductor 10K and the other first transfer rollers 54 face the corresponding photoconductors 10.

Each of the first transfer rollers 54K to 54G are driven to rotate as the intermediate transfer belt 51 rotates. The toner images formed on the photoconductors 10K to 10G are sequentially transferred to the surface of the intermediate transfer belt 51 while being superposed on top of one another. The second transfer roller 55 is disposed so as to face the back-up roller 52. The intermediate transfer belt 51 and a sheet P are nipped between the second transfer roller 55 and the back-up roller 52 and thus the toner images that have been transferred to the intermediate transfer belt 51 are transferred to the sheet P.

The fixing device 60 includes a heating portion 61, which serves as a first transportation unit, and a pressure roller 62, which serves as a second transportation unit and transports the sheet P while pressing the sheet P. The fixing device 60 heats and presses the sheet P to fix, to the sheet P, unfixed toners that have been transferred to the sheet P. The heating portion 61 according to the exemplary embodiment includes a fixing belt 61*a*, an internal heating roller 61*b*, an external heating roller 61*c*, transporting rollers 61*d* and 61*e*, a slide sheet 61*f*, and a fixing pad 61*g*.

The fixing device 60 includes a first driving unit 63 and a second driving unit 64, which are controlled by the rotation controller 2*a*. The first driving unit 63 drives the external heating roller 61*c* and the second driving unit 64 drives the pressure roller 62. The detail of the fixing device 60 according to the exemplary embodiment will be described below.

Each of the cleaning units 70 (70K to 70G) removes remnants such as a toner remaining on the surface of the corresponding photoconductor 10 after the toner image has been transferred to the sheet P. Multiple sheets P are stored in the sheet storage 80. The sheets P are picked up by a pick-up roller 90 from the sheet storage 80 and transported to the transfer unit 50 by the transporting rollers 91*a*, 91*b*, and 91*c*.

Figure 2:
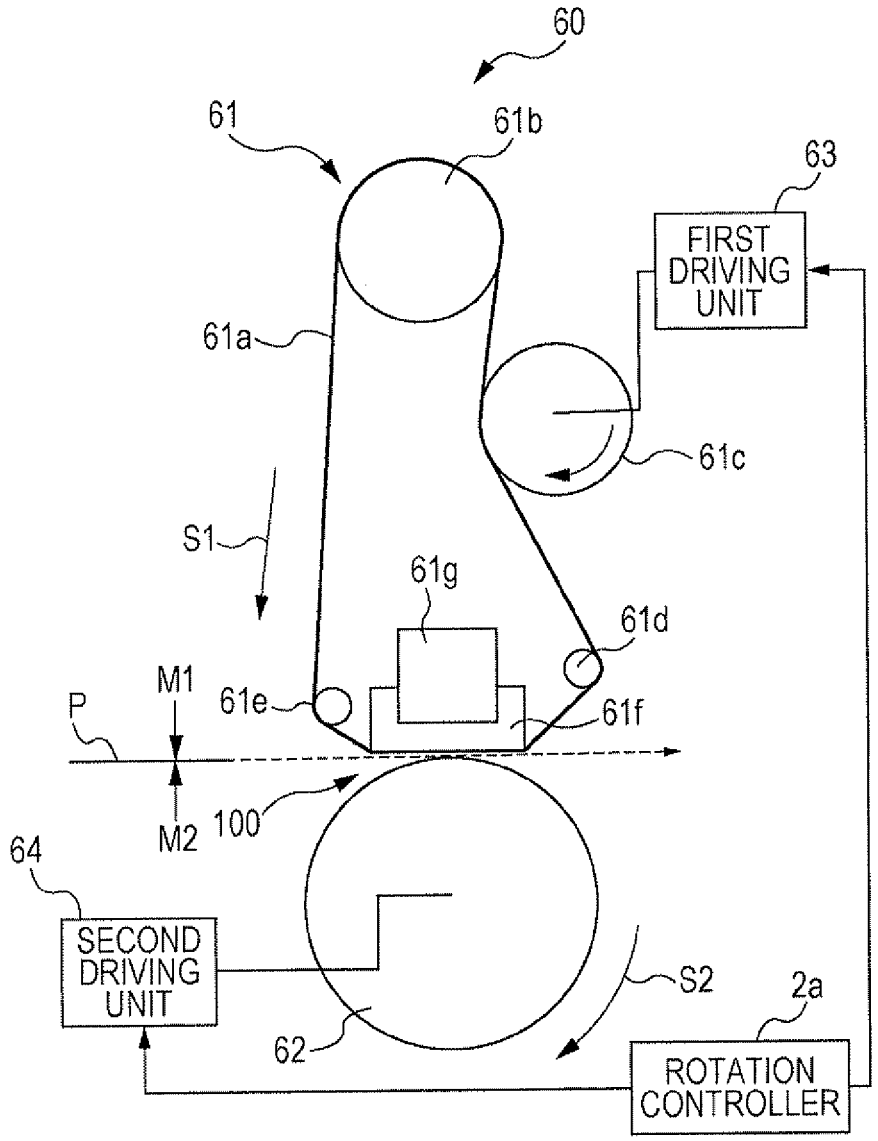
FIG. 2 schematically illustrates the fixing device according to the exemplary embodiment.

Now, the fixing device 60 according to the exemplary embodiment will be described. FIG. 2 illustrates a configuration of the fixing device 60. As illustrated in FIG. 2, the fixing device 60 includes the heating portion 61 and the pressure roller 62. The fixing device 60 heats and melts, by using the heating portion 61, toners that have been transferred to the sheet P nipped between the heating portion 61 and the pressure roller 62 and presses the toners with the pressure roller 62 so that the toners are fixed to the sheet P.

The heating portion 61 includes the fixing belt 61*a*, which is a rotatable endless belt, the internal heating roller 61*b*, the external heating roller 61*c*, and the transporting rollers 61*d* and 61*e*. The internal heating roller 61*b*, the external heating roller 61*c*, and the transporting rollers 61*d* and 61*e* are disposed so as to stretch the fixing belt 61*a*. The internal heating roller 61*b* has a heater and heats the inner side (inner surface) of the fixing belt 61*a*. The external heating roller 61*c* has a heater and heats the outer side (outer surface) of the fixing belt 61*a*. The toners that have been transferred to the sheet P nipped between the thus heated fixing belt 61*a* and the pressure roller 62 are heated and pressed, and thus fixed to the sheet P.

The heating portion 61 includes a slide sheet 61*f*, which is attached to the surface of the fixing pad 61*g* so as to face the pressure roller 62 and slide over the fixing belt 61*a*. The slide sheet 61*f* is made of a glass fiber sheet impregnated with, for example, a fluoropolymer and has a small sliding resistance to the fixing belt 61*a*.

The fixing device 60 also includes the first driving unit 63 and the second driving unit 64. The first driving unit 63 drives the external heating roller 61*c* to rotate such that the fixing belt 61*a* moves at a first speed S1. The second driving unit 64 drives the pressure roller 62 to rotate at a second speed S2. The first driving unit 63 and the second driving unit 64 are controlled by the rotation controller 2*a* of the controller 2 such that the fixing belt 61*a* moves at the first speed S1 and the pressure roller 62 rotates at the second speed S2.

A shearing force applying unit 100 is described now. Here, an application of a shearing force means applying a shearing force to a metallic toner containing molten metallic pigment flakes by the heating portion 61 (fixing belt 61*a*) heating the toner and by the pressure roller 62 pressing the toner. Specifically, a shearing force is applied to the metallic toner, particularly to the metallic pigment flakes included in the metallic toner.

When the rotation controller 2*a* controls the first driving unit 63 and the second driving unit 64 so as to make the first speed S1, at which the recording medium is transported and the fixing belt 61*a* is driven to move by the first driving unit 63, different from the second speed, at which the recording medium is transported and the pressure roller 62 is driven by the second driving unit 64 to rotate, the shearing force applying unit 100 applies a shearing force to the metallic toner on the sheet P.

In other words, when a sheet P is transported while being nipped between and pressed by the fixing belt 61*a* and the pressure roller 62, a surface M1 of the sheet P to which the metallic toner has been transferred and a surface M2 of the sheet P that is on the back of the surface M1 move at different speeds, thereby applying a shearing force between the surface M1 and the surface M2.

Figure 3A:
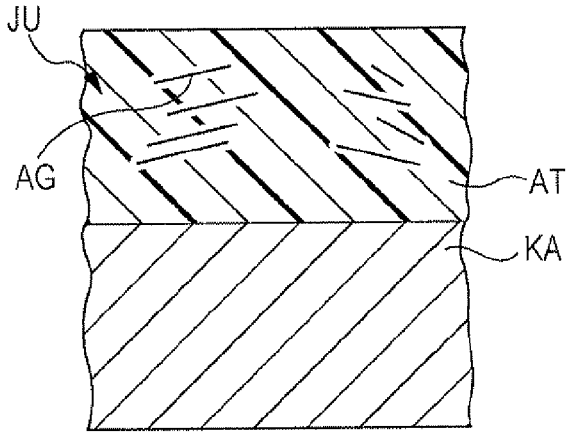
FIGS. 3A and 3B schematically illustrate how the arrangement of flakes of pigments changes when a shearing force is applied.
Figure 3B:
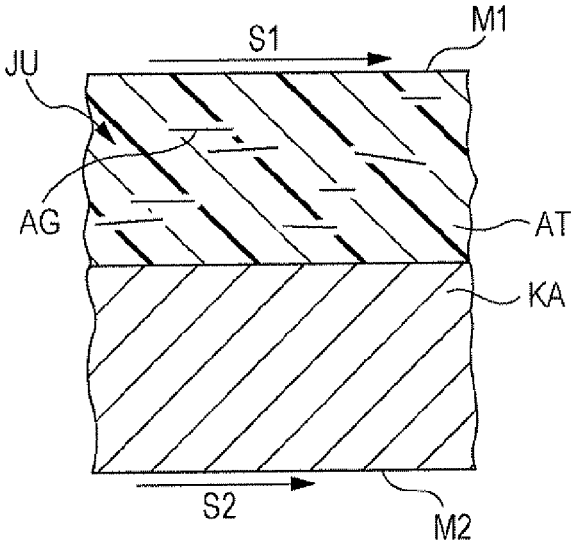

Referring now to FIGS. 3A and 3B, a sheet P to which a shearing force is applied by the shearing force applying unit 100 is described. FIG. 3A illustrates a state of the sheet P to which a metallic toner has been transferred and a shearing force has not been applied. FIG. 3B illustrates a state of the sheet P to which the metallic toner has been transferred and a shearing force has been applied. An aluminum toner layer AT illustrated in each of FIGS. 3A and 3B is an example of a toner layer formed on the sheet P including a metallic toner image.

As illustrated in FIG. 3A, in the aluminum toner layer AT that has been transferred to paper KA before a shearing force is applied to the paper KA, aluminum pigment flakes AG, which are examples of metallic pigment flakes, are disposed so as to be superposed on top of one another in a resin JU. Here, a thermoplastic resin is used as an example of the resin JU.

FIG. 3B illustrates the state where the area coated by the aluminum pigment flakes AG is increased as a result of an application of a shearing force to the aluminum toner layer AT. In other words, by applying a shearing force between the surface M1, which moves at the first speed S1, and the surface M2, which moves at the second speed S2, the superposed aluminum pigment flakes AG are moved in a transportation direction as a result of the application of the shearing force. Thus, the aluminum pigment flakes AG form a wide coating as illustrated in FIG. 3B.

Figure 4:
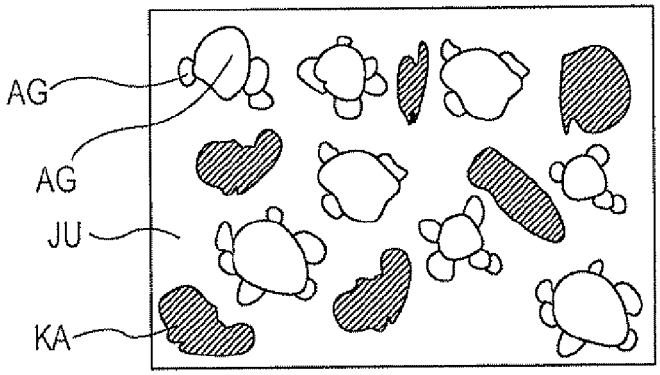
FIG. 4 schematically illustrates a fixing state of a metallic toner.

FIG. 4 schematically illustrates a state of the surface M1 that has been subjected to a fixing operation when viewed from above. As illustrated in FIG. 4, the aluminum pigment flakes AG are superposed on top of one another in the resin JU. Here, the area coated by the aluminum pigment flakes AG is not sufficiently large and thus a large area of the paper KA is exposed to the outside. When the surface M1 is in such a state, the amount of reflected light from the aluminum pigment flakes AG is said to be insufficient.

Figure 5A:
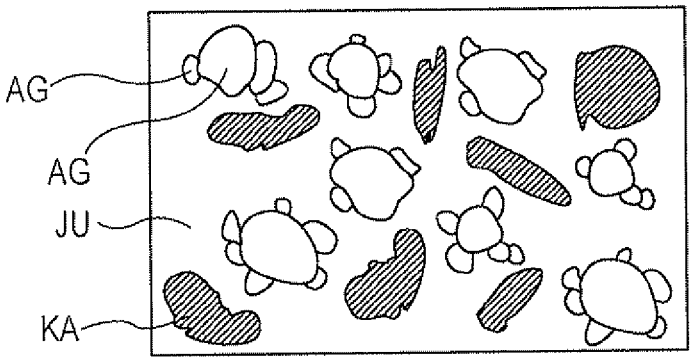
FIGS. 5A, 5B, and 5C schematically illustrate surface roughness in different fixing states of a metallic toner.
Figure 5B:
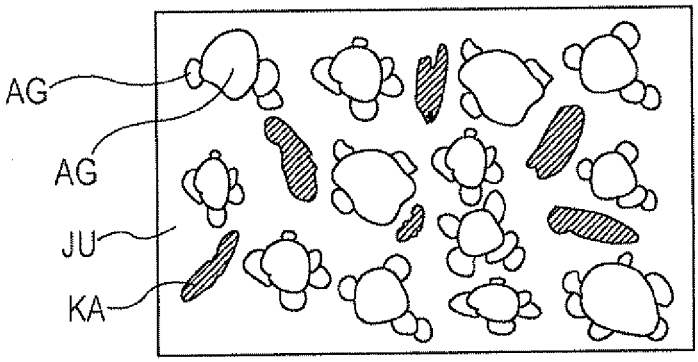
Figure 5C:
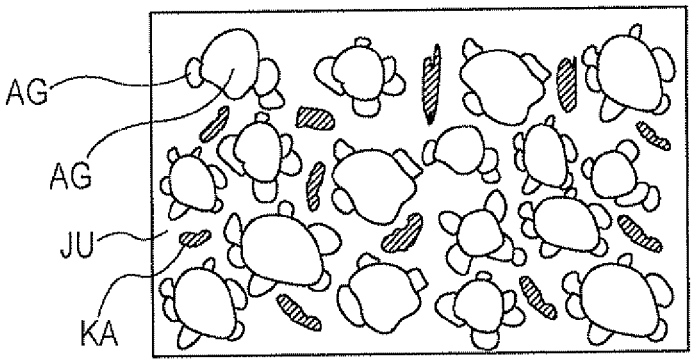
Figure 6A:
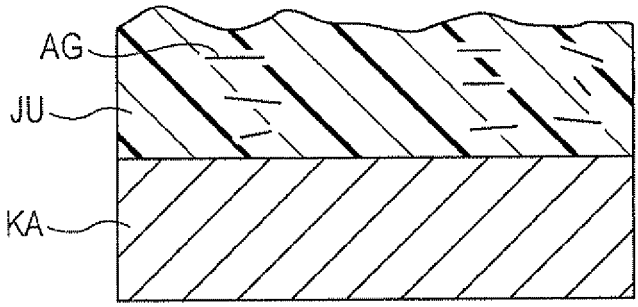
FIGS. 6A, 6B, and 6C schematically illustrate surface roughness in different fixing states of a metallic toner when viewed in a cross section.
Figure 6B:
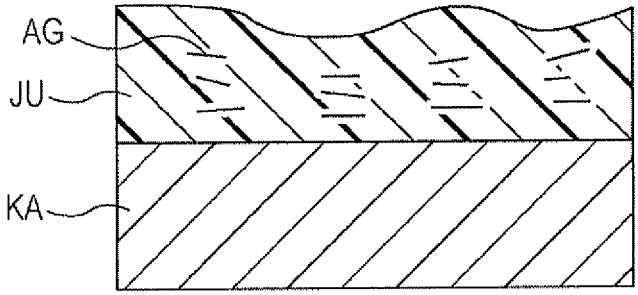
Figure 6C:
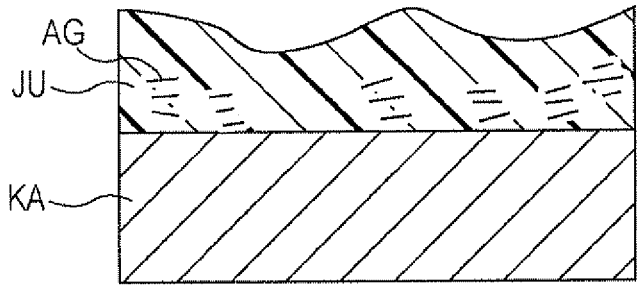
Figure 7:
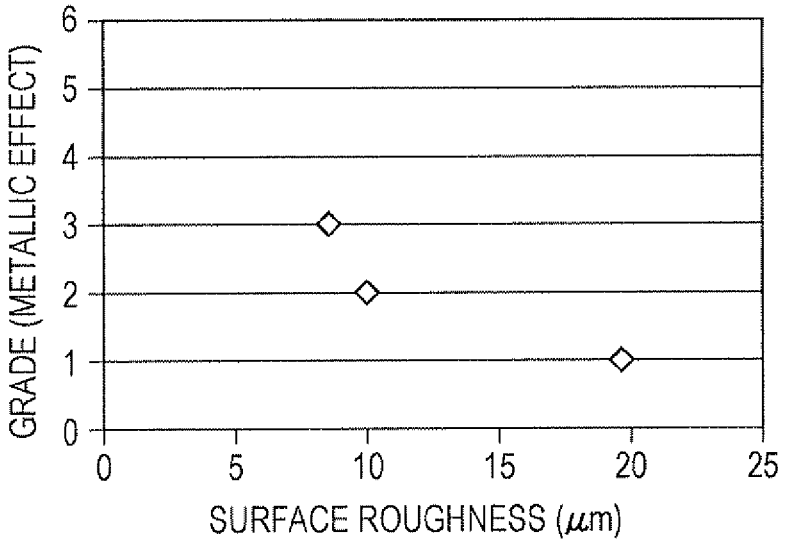
FIG. 7 is a graph showing the relationship between the surface roughness and the metallic effect.

Referring now to FIGS. 5A to 7, a metallic effect will be described. FIGS. 5A to 5C each illustrate a state of the surface M1 that has been subjected to a fixing operation when viewed from above. FIG. 5A schematically illustrates the surface M1 having a small surface roughness, FIG. 5B schematically illustrates the surface M1 having a medium surface roughness, and FIG. 5C schematically illustrates the surface M1 having a large surface roughness. FIGS. 6A to 6C are cross sectional views of the surface M1 illustrated in FIGS. 5A to 5C, where FIG. 5A corresponds to FIG. 6A, FIG. 5B corresponds to FIG. 6B, and FIG. 5C corresponds to FIG. 6C. FIG. 7 is a graph in which the horizontal axis indicates the surface roughness (μm) of the surface M1 and the vertical axis indicates the grade of the metallic effect.

As illustrated in FIGS. 5A to 6C, when the metallic toner includes a small number of aluminum pigment flakes AG, the surface roughness is small, whereas when the metallic toner includes a large number of aluminum pigment flakes AG, the surface roughness is large. As illustrated in FIG. 7, when the surface roughness is large, the metallic effect is graded low.

In other words, as illustrated in FIGS. 5A to 7, when there are a small number of aluminum pigment flakes AG, the metallic effect is graded medium or 3. In this case, because there are a small number of pigment flakes AG, an improvement of the metallic effect is not expected even when a shearing force is applied to the pigment flakes AG. On the other hand, when there are a large number of aluminum pigment flakes AG, the metallic effect is graded low or 1. Here, when a shearing force is applied to the aluminum pigment flakes AG that cause a large surface roughness due to the flakes AG being superposed on top of one another, the pigment flakes AG are spread to a wider area. Thus, the surface roughness is reduced and the flakes are arranged more evenly.

The image forming apparatus 1 may operate in a quality-first mode and a highly metallic mode. The controller 2 switches between the quality-first mode and the highly metallic mode. In the quality-first mode, the image forming units 3S and 3G form metallic toner images containing a small number of metallic pigment flakes and a small magnitude of shearing force is applied to the metallic toner. In the highly metallic mode, the image forming units 3S and 3G form metallic toner images containing a large number of metallic pigment flakes and a large magnitude of shearing force is applied to the metallic toner.

In the quality-first mode, the consumption of metallic toner is small. The shearing force is reduced by making the difference between the first speed S1 and the second speed S2 illustrated in FIGS. 3A and 3B smaller.

In the highly metallic mode, on the other hand, the consumption of metallic toner is large and the metallic effect improves. The shearing force is increased by making the difference between the first speed S1 and the second speed S2 illustrated in FIGS. 3A and 3B larger.

Now, an operation of the image forming apparatus 1 including the fixing device 60 according to the exemplary embodiment will be described. First, the shearing force controller 2*b* and the image converter 2*c* illustrated in FIG. 1 will be described. When a metallic image is to be formed on a sheet P, the shearing force controller 2*b* operates the rotation controller 2*a* and performs such a control that the first speed S1 is made different from the second speed S2.

When, on the other hand, a color image is to be formed on a sheet P, the shearing force controller 2*b* does not operate the rotation controller 2*a* so that, for example, the first speed S1 coincides with the second speed S2.

The image converter 2*c* converts an image on the basis of the input image data such that an end portion of the input image in the transportation direction is shortened in response to an application of the shearing force from the shearing force applying unit 100. By converting the input image in this manner, misregistration of the image is prevented. The image converter 2*c* will be described with reference to FIGS. 8A to 8D.

Figure 8A:
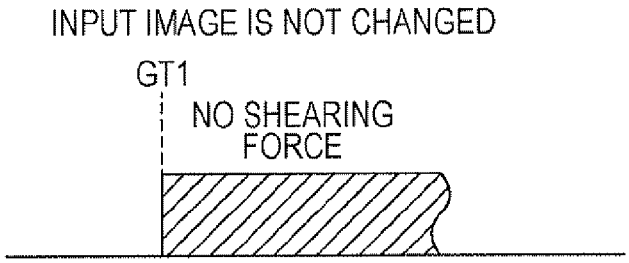
FIGS. 8A, 8B, 8C, and 8D schematically illustrate image conversion.
Figure 8B:
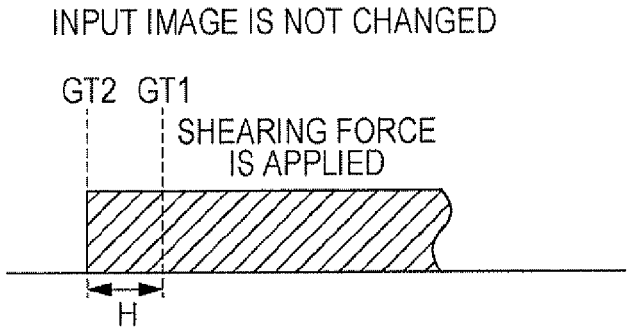

FIGS. 8A to 8D schematically illustrate how the image converter 2*c* converts the input image. FIG. 8A illustrates the state where the edge of an input image that is not converted and to which a shearing force is not applied is located at an image edge GT1. FIG. 8B illustrates the state where the edge of an input image that is not converted and to which a shearing force has been applied is located at an image edge GT2.

Figure 8C:
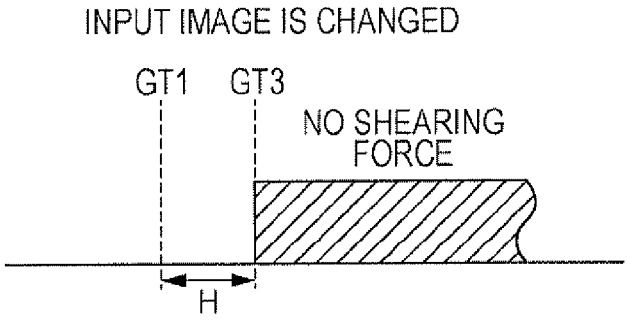
Figure 8D:
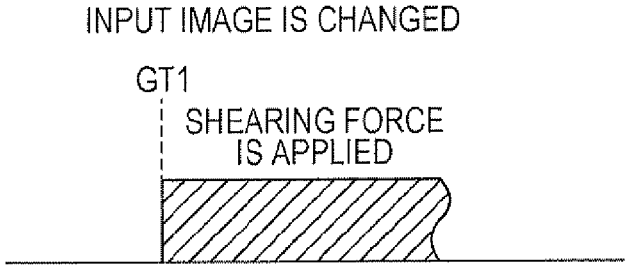

As illustrated in FIG. 83, the image edge GT2 is shifted a distance H from the image edge GT1 in the direction in which the shearing force is applied. As illustrated in FIGS. 8A and 8B, an application of a shearing force to an image causes misregistration of the image. FIG. 8C illustrates the state where the edge of an input image that has been converted and to which a shearing force is not applied is located at an image edge GT3. FIG. 8D illustrates the state where the edge of an input image that has been converted and to which a shearing force has been applied is located at the image edge GT1.

That is, when the input image has been converted, the edge of the image to which a shearing force is not applied is located at the image edge GT3, while the edge of the image to which a shearing force has been applied is located at the image edge GT1. As described above, by operating the image converter 2*c* and shifting the edge of the image a distance H in the direction in which a shearing force is applied, misregistration of the image is preventable when a shearing force is applied to an image.

Figure 9:
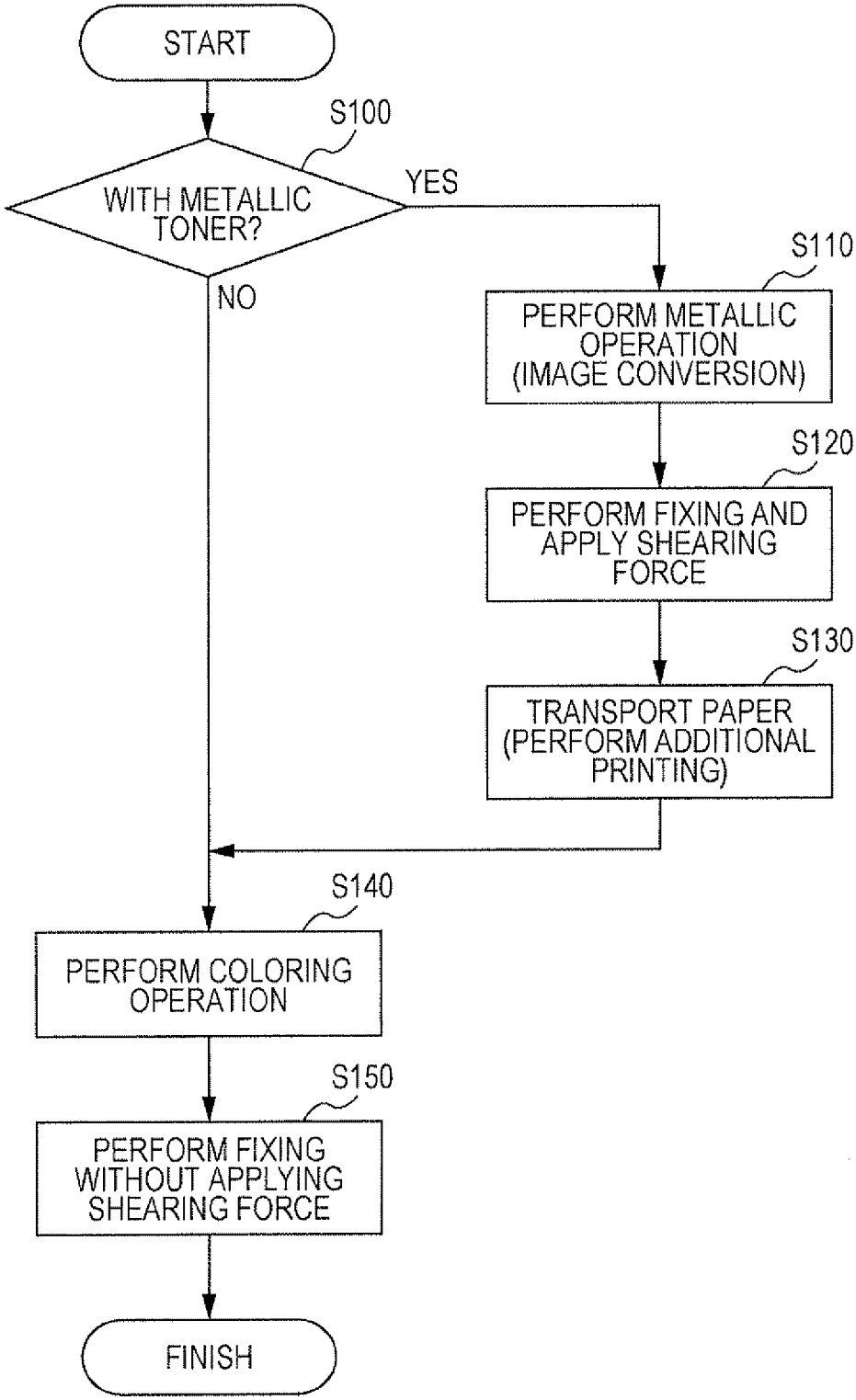
FIG. 9 is a flowchart of exemplary image processing performed by the fixing device according to the exemplary embodiment.

FIG. 9 is a flowchart showing an exemplary operation of the image forming apparatus 1. As illustrated in FIG. 9, when the image forming apparatus 1 starts image formation, the shearing force controller 2*b* determines whether or not a metallic image is to be formed (Step S100).

When the shearing force controller 2*b* determines that "a metallic image is to be formed" (YES in Step S100), metallic images are started to be formed and the image converter 2*c* that converts an input image is operated (Step S110). Metallic toner images are formed by the image forming units 3S and 3G on the basis of the input image thus converted, first transferred by the transfer unit 50, and then second transferred to a sheet P.

The sheet P to which the metallic toner images have been transferred is transported to the fixing device 60, at which a shearing force is applied to the sheet P, and the metallic toner images are fixed to the sheet P by the shearing force controller 2*b* operating the rotation controller 2*a* (Step S120). The sheet P to which the shearing force has been applied and the metallic toner images have been fixed is transported to the transfer unit 50 by the transporting rollers 91*d*, 91*f*, 91*g*, 91*b*, and 91*c*.

The transfer unit 50 performs additional printing on the sheet P that has been transported to the transfer unit 50 and to which the metallic toner images have been fixed (Step S130). Here, the additional printing is an operation of transferring an additional toner image to a recording medium to which a previous toner image has been fixed in order to fix the toner images to the recording medium.

Subsequently, color images are started to be formed on the sheet P to which the metallic toner images have been fixed (Step S140). Specifically, when an operation of forming color images is started, color toner images are formed by the image forming units 3K to 3C on the basis of the input image, first transferred to the transfer unit 50, and then second transferred to (additionally printed on) the sheet P.

The sheet P on which the color toner images have been additionally printed is transported to the fixing device 60, at which the color toner images are fixed to the sheet P (Step S150). During the fixing operation, the shearing force controller 2*b* determines the images as color images and thus the rotation controller 2*a* does not apply a shearing force to the sheet P. The sheet P on which the color images have been additionally printed on the metallic images is transported by the transporting rollers 91*h* and thus the image forming apparatus 1 finishes the image formation.

On the other hand, when the shearing force controller 2*b* determines that "a metallic image is not to be formed" (NO in Step S100), color images are started to be formed (Step S140). Specifically, when an operation of forming color images is started, color toner images are formed by the image forming units 3K to 3C on the basis of the input image, first transferred to the transfer unit 50, and then second transferred to the sheet P. The sheet P to which the color toner images have been transferred is transported to the fixing device 60, at which the color toner images are fixed to the sheet P (Step S150). The sheet P to which the color images have been transferred is transported by the transporting rollers 91*h* and thus the image forming apparatus 1 finishes the image formation.

In the flowchart of FIG. 9, the image forming apparatus 1 additionally prints the color images on the sheet P on which the metallic images have been formed, but the present invention is not limited to this. For example, the image forming apparatus 1 may additionally print metallic images on a sheet P on which color images have been formed. In the case of this additional printing, the sheet P is spotted with metallic pigment flakes and thus has an intensive metallic effect although the metallic pigment flakes are not spread uniformly.

Figure 10A:
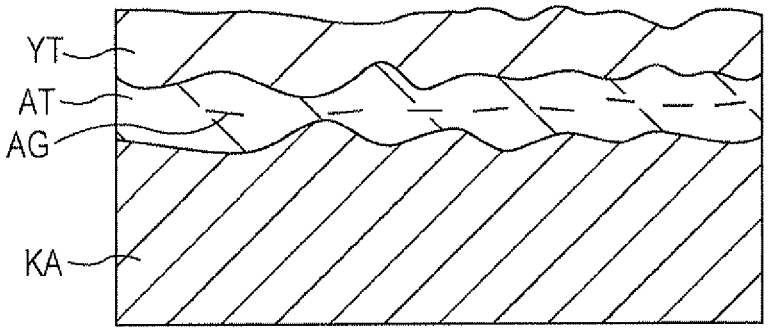
FIGS. 10A and 10B schematically illustrate states of a metallic toner with or without additional printing.
Figure 10B:
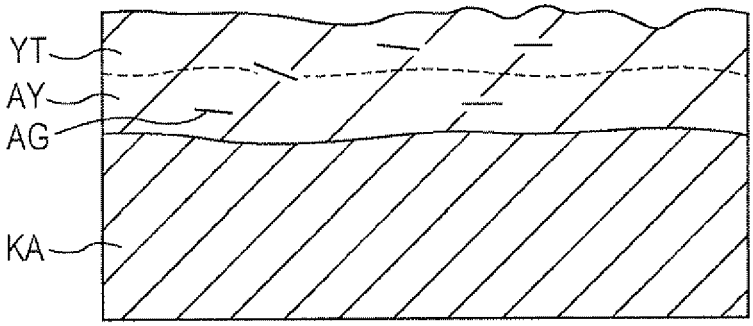

FIGS. 10A and 10B schematically illustrate the cases where the additional printing is performed and not performed. FIG. 10A illustrates the case where additional printing is performed and an aluminum toner layer AT underlies a yellow toner layer YT. FIG. 10B illustrates the case where additional printing is not performed and an aluminum toner layer AT underlies a yellow toner layer YT. As illustrated in FIG. 10A, by performing additional printing, the aluminum pigment flakes AG are maintained at a state of being included in the aluminum toner layer AT and thus are evenly arranged. On the other hand, as illustrated in FIG. 10B, without the additional printing, the aluminum pigment flakes AG are included in the aluminum toner layer AT and the yellow toner layer YT and thus are unevenly arranged.

Although the sheet P is transported by the transporting rollers 91*h* as described above, the sheet P may be directed to the transporting rollers 91*d* so that an image is formed on the back side. In this case, the sheet P directed to the transporting rollers 91*d* is transported to the transporting rollers 91*e*, at which the sheet P is reversed. Then, the sheet P is transported to the transfer unit 50 via the transporting rollers 91*f*, 91*g*, 91*b*, and 91*c*.

According to the exemplary embodiment described above, the metallic effect is improved by having a simple configuration in which the heating portion 61 is driven by the first driving unit 63, the pressure roller 62 is driven by the second driving unit 64, and the heating portion 61 and the pressure roller 62 move at different speeds so that a shearing force is applied to aluminum pigment flakes AG.

Other Exemplary Embodiments

The fixing device 60 according to the exemplary embodiment and the image forming apparatus 1 including the fixing device 60 have been described thus far. The present invention, however, is not limited to the above-described exemplary embodiment and may include other exemplary embodiments. Some of the other exemplary embodiments are described below.

Figure 11:
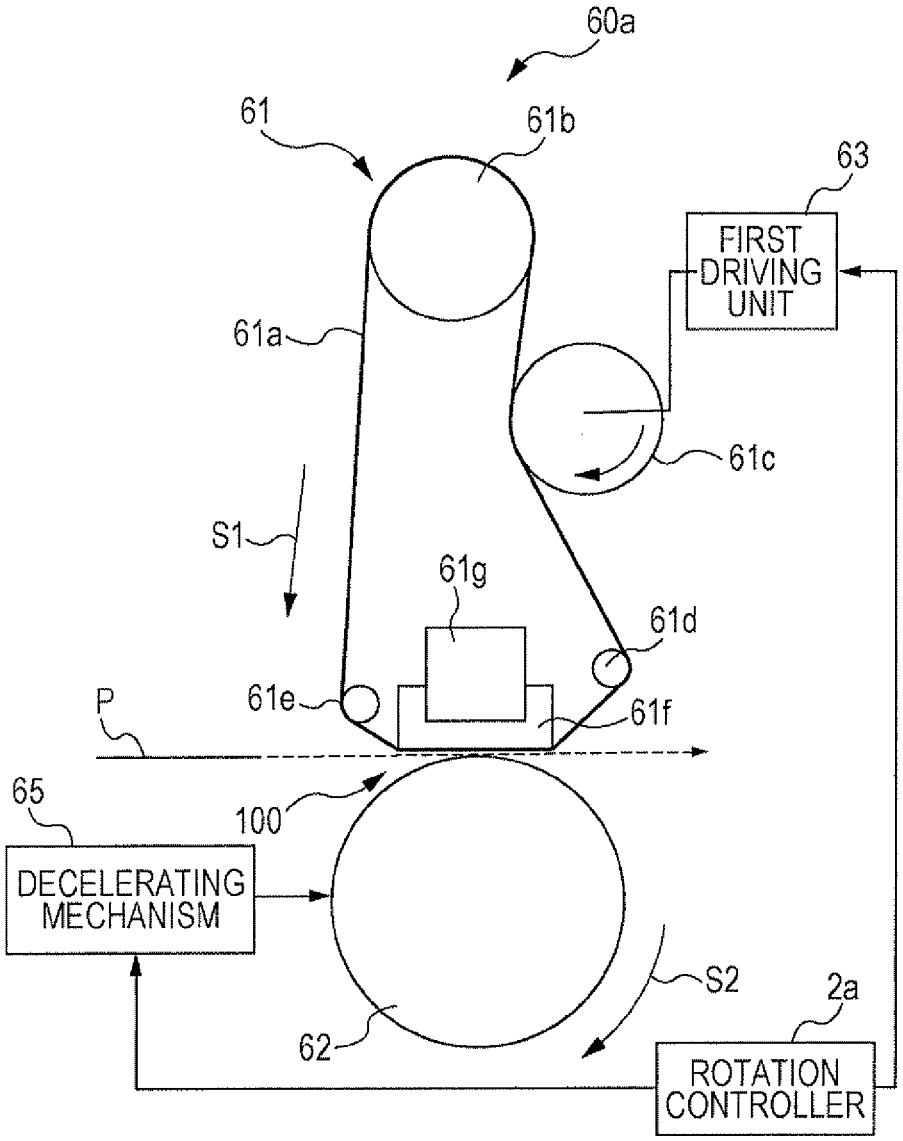
FIG. 11 schematically illustrates a fixing device according to a different exemplary embodiment.

Although the fixing device 60 according to the exemplary embodiment includes a second driving unit 64 to drive the pressure roller 62, the present invention is not limited to this configuration. For example, a fixing device 60*a* as illustrated in FIG. 11 may be included instead. The fixing device 60*a* does not include the second driving unit 64 to drive the pressure roller 62 and the pressure roller 62 is driven to rotate by rotation of the fixing belt.

As illustrated in FIG. 11, the fixing device 60*a* includes a decelerating mechanism 65 to rotate the pressure roller 62 at the second speed. The decelerating mechanism 65 may be controlled by the rotation controller 2*a*. The configuration of the fixing device 60*a* is simplified by eliminating the second driving unit 64.

Figure 12:
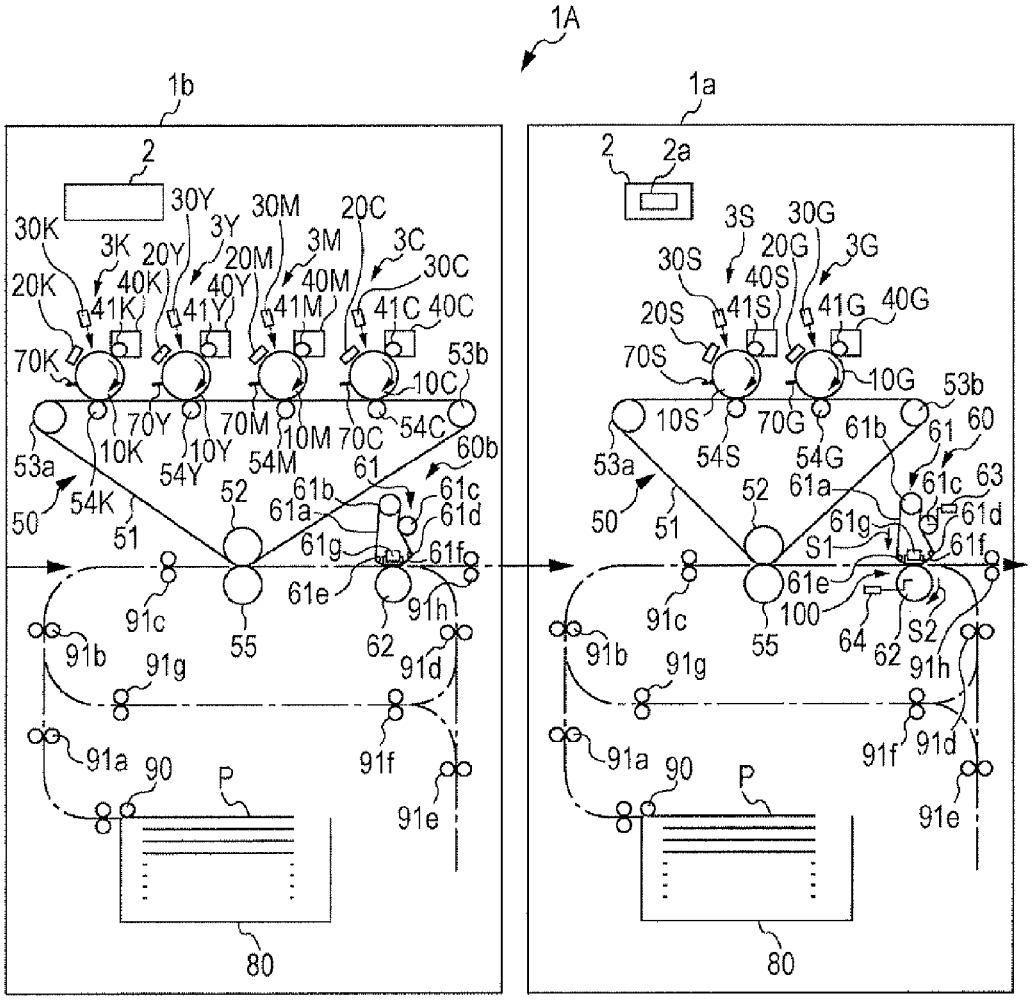
FIG. 12 schematically illustrates an image forming apparatus including the fixing device according to the different exemplary embodiment.

The image forming apparatus 1 according to the exemplary embodiment includes the image forming units 3K to 3G that form color images and metallic images, but the present invention is not limited to this configuration. For example, an image forming apparatus 1A obtained by combining a first image forming apparatus 1*a* and a second image forming apparatus 1*b* as illustrated in FIG. 12 may be employed.

The first image forming apparatus 1*a* includes, for example, image forming units 3S and 3G and a fixing device 60 that includes a shearing force applying unit 100 and that fixes metallic toner images to a sheet. The first image forming apparatus 1*a* forms metallic images. The second image forming apparatus 1*b* includes, for example, image forming units 3K to 3C and a fixing device 60*b* that fixes color toner images to a sheet. The second image forming apparatus 1*b* forms color images.

The image forming apparatus 1A is flexibly operable as having a configuration formed by combining the first image forming apparatus 1*a*, which forms metallic images and includes the fixing device 60 according to the exemplary embodiment, and the second image forming apparatus 1*b*, which forms color images and includes the fixing device 60*b* that does not include the shearing force applying unit 100.

Other components of the image forming apparatus 1A are the same as those of the image forming apparatus 1 and thus are not described here.

In another exemplary embodiment, a metallic toner having a melt viscosity lower than that of a color toner may be used.

In the case where the metallic toner has a melt viscosity lower than that of a color toner, a shearing force is more effectively applied to the metallic pigment flakes included in the metallic toner due to the melt viscosity of the metallic toner being lower. Moreover, a confusion of the metallic toner and the color toner that occurs when an image is formed without additional printing is prevented.

The image forming apparatus 1 according to the exemplary embodiment includes the image converter 2*c* that converts an image such that an end portion of an input image is shortened in a transportation direction, but the present invention is not limited to this configuration. For example, the image forming apparatus 1 may exclude the image converter 2*c* if misregistration of the image does not affect the sense of sight even after the shearing force applying unit 100 is operated.

In this exemplary embodiment, metallic images are formed by the image forming units 3S and 3G and color images are formed by the image forming units 3K to 3C, but the present invention is not limited to this configuration. For example, only the image forming unit 3S may form a metallic image and an image forming unit that forms an image with a transparent toner as a color image may be included.

In this exemplary embodiment, the heating portion, which heats and melts the metallic toner on the sheet P, and the shearing force applying unit 100, which applies a shearing force to the molten metallic toner in the transportation direction of the sheet P, form the fixing device 60, but the present invention is not limited to this configuration. For example, the heating portion and the shearing force applying unit do not have to form the fixing device 60.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

an image forming unit that forms a metallic toner image on a recording medium using a metallic toner containing flakes of metallic pigment; and a heating portion that heats and melts the metallic toner on the recording medium, wherein a first shearing force is applied to the molten metallic toner in a transportation direction of the recording medium.

2. The image forming apparatus according to claim 1, further comprising:

a first transportation unit; and a second transportation unit that transports the recording medium while pressing the recording medium nipped between the second transportation unit and the first transportation unit, wherein the first shearing force is applied to the metallic toner on the recording medium by changing speeds at which the first transportation unit and the second transportation unit transport the recording medium.

3. The image forming apparatus according to claim 2, further comprising a fixing device that includes the heating portion, the first transportation unit, and the second transportation unit.

4. The image forming apparatus according to claim 3, further comprising a controller, wherein the image forming unit forms a color toner image using a color toner such that the color toner image is superposed on the metallic toner image formed by using the metallic toner to which the first shearing force has been applied, and wherein the controller performs such a control that a second shearing force smaller than the first shearing force is applied to the color toner of the color toner image superposed on the metallic toner image.

5. The image forming apparatus according to claim 4, wherein the controller switches between a quality-first mode and a highly metallic mode, wherein, in the quality-first mode, the image forming unit forms a metallic toner image containing a small number of flakes of the metallic pigment and a small shearing force is applied to the metallic toner, and wherein, in the highly metallic mode, the image forming unit forms a metallic toner image containing a large number of flakes of the metallic pigment and a large shearing force is applied to the metallic toner.

6. The image forming apparatus according to claim 2, further comprising a controller, wherein the image forming unit forms a color toner image using a color toner such that the color toner image is superposed on the metallic toner image formed by using the metallic toner to which the first shearing force has been applied, and wherein the controller performs such a control that a second shearing force smaller than the first shearing force is applied to the color toner of the color toner image superposed on the metallic toner image.

7. The image forming apparatus according to claim 6, wherein the controller switches between a quality-first mode and a highly metallic mode, wherein, in the quality-first mode, the image forming unit forms a metallic toner image containing a small number of flakes of the metallic pigment and a small shearing force is applied to the metallic toner, and wherein, in the highly metallic mode, the image forming unit forms a metallic toner image containing a large number of flakes of the metallic pigment and a large shearing force is applied to the metallic toner.

8. The image forming apparatus according to claim 2, further comprising:

a driving unit that drives the first transportation unit, and a decelerating mechanism that reduces the speed at which the second transportation unit transports the recording medium by causing the second transportation unit to be driven by the driving of the first transportation unit.

9. The image forming apparatus according to claim 1, further comprising a fixing device that includes the heating portion, the first transportation unit, and the second transportation unit.

10. The image forming apparatus according to claim 9, further comprising a controller, wherein the image forming unit forms a color toner image using a color toner such that the color toner image is superposed on the metallic toner image formed by using the metallic toner to which the first shearing force has been applied, and wherein the controller performs such a control that a second shearing force smaller than the first shearing force is applied to the color toner of the color toner image superposed on the metallic toner image.

11. The image forming apparatus according to claim 10, wherein the controller switches between a quality-first mode and a highly metallic mode, wherein, in the quality-first mode, the image forming unit forms a metallic toner image containing a small number of flakes of the metallic pigment and a small shearing force is applied to the metallic toner, and wherein, in the highly metallic mode, the image forming unit forms a metallic toner image containing a large number of flakes of the metallic pigment and a large shearing force is applied to the metallic toner.

12. The image forming apparatus according to claim 1, further comprising a controller, wherein the image forming unit forms a color toner image using a color toner such that the color toner image is superposed on the metallic toner image formed by using the metallic toner to which the first shearing force has been applied, and wherein the controller performs such a control that a second shearing force smaller than the first shearing force is applied to the color toner of the color toner image superposed on the metallic toner image.

13. The image forming apparatus according to claim 12, wherein the controller switches between a quality-first mode and a highly metallic mode, wherein, in the quality-first mode, the image forming unit forms a metallic toner image containing a small number of flakes of the metallic pigment and a small shearing force is applied to the metallic toner, and wherein, in the highly metallic mode, the image forming unit forms a metallic toner image containing a large number of flakes of the metallic pigment and a large shearing force is applied to the metallic toner.

14. The image forming apparatus according to claim 1, further comprising an image converter that converts an image on the basis of data of an input image such that an end portion of the input image is shortened in the transportation direction in response to an application of the shearing force.

15. The image forming apparatus according to claim 1, wherein the metallic toner has a lower melt viscosity than a predetermined color toner.

16. A fixing device comprising:

a heating portion that heats and melts a metallic toner disposed on a recording medium, the metallic toner containing flakes of metallic pigment and being used by a predetermined image forming unit to form a metallic toner image; and a shearing force applying unit that applies a shearing force to the molten metallic toner in a transportation direction of the recording medium, wherein the shearing force applying unit includes a first transportation unit and a second transportation unit that transports the recording medium while pressing the recording medium nipped between the second transportation unit and the first transportation unit, and wherein the shearing force applying unit applies the shearing force to the metallic toner disposed on the recording medium by changing speeds at which the first transportation unit and the second transportation unit transport the recording medium.

17. An image forming apparatus comprising:

an image forming unit that forms a metallic toner image on a recording medium using a metallic toner containing flakes of metallic pigment; and a fixing unit that fixes the metallic toner on the recording medium to the recording medium by applying a shearing force to the metallic toner on the recording medium in a transportation direction of the recording medium.

18. The image forming apparatus according to claim 17, wherein the fixing unit includes a first transportation unit and a second transportation unit that move and transport the recording medium therebetween, and speeds at which the first transportation unit and the second transportation unit move are different from each other.

19. The image forming apparatus according to claim 18, wherein a difference between the speeds at which the first transportation unit and the second transportation unit move when the fixing unit fixes the metallic toner to the recording medium is larger than a difference between the speeds at which the first transportation unit and the second transportation unit move when the fixing unit fixes a color toner superposed on the metallic toner that has been fixed on the recording medium to the recording medium.

* * * * *